US008667886B2

(12) United States Patent
Hendron et al.

(10) Patent No.: US 8,667,886 B2
(45) Date of Patent: Mar. 11, 2014

(54) VARIABLE OUTPUT HYDRAULIC ACTUATOR SYSTEM

(75) Inventors: Scott Svend Hendron, Dubuque, IA (US); Robert Moore, Dickeyville, WI (US)

(73) Assignee: Deere and Company, Moline, IL (US)

( * ) Notice: Subject to any disclaimer, the term of this patent is extended or adjusted under 35 U.S.C. 154(b) by 883 days.

(21) Appl. No.: 12/631,257

(22) Filed: Dec. 4, 2009

(65) Prior Publication Data

US 2011/0132185 A1 Jun. 9, 2011

(51) Int. Cl.
*F15B 13/04* (2006.01)

(52) U.S. Cl.
USPC ..... 91/464

(58) Field of Classification Search
USPC ..... 60/414, 415, 464; 91/418
See application file for complete search history.

(56) References Cited

U.S. PATENT DOCUMENTS

| | | | | |
|---|---|---|---|---|
| 4,628,499 | A | 12/1986 | Hammett | |
| 5,211,196 | A * | 5/1993 | Schwelm | 91/464 |
| 5,455,769 | A | 10/1995 | Panoushek et al. | |
| 6,502,393 | B1 * | 1/2003 | Stephenson et al. | 60/414 |
| 6,763,661 | B2 * | 7/2004 | Tabor et al. | 60/327 |
| 7,269,944 | B2 | 9/2007 | Zhang et al. | |
| 2003/0209134 | A1 | 11/2003 | Tabor et al. | |
| 2005/0211936 | A1 * | 9/2005 | Tabor et al. | 251/129.04 |
| 2006/0254239 | A1 | 11/2006 | Fackler et al. | |

OTHER PUBLICATIONS

Minibooster Hydraulic Pressure Boosters, http://www.minibooster.com/, Dec. 10, 2008.
Adambro et al., Pulse Width Modulation, http://en.wikipedia.org/wiki/Pulse-width_modulation, Last Modified Jan. 6, 2011.
Digital Displacement Technology, http://www.artemisip.com/technology.htm, Jan. 29, 2008.
European Patent Office, European Search Report and Opinion for EP Application No. 10192682.2, dated Mar. 25, 2011, 7 pages.

* cited by examiner

*Primary Examiner* — Thomas E Lazo
(74) *Attorney, Agent, or Firm* — Faegre Baker Daniels LLC

(57) ABSTRACT

Methods and apparatuses of generating a dynamic variable average flow applied by a hydraulic system of a vehicle.

22 Claims, 3 Drawing Sheets

VARIABLE OUTPUT HYDRAULIC ACTUATOR SYSTEM

FIELD

The field relates generally to hydraulic control systems. More particularly, the field relates to methods and apparatus for providing a variable force and/or velocity from a hydraulic system.

BACKGROUND

Many pieces of construction equipment use hydraulic systems to control the functions performed by the equipment. The construction equipment operator is provided with one or more input devices operably coupled to one or more hydraulic actuators, such as hydraulic cylinders, which control the relative positions of various components or devices of the equipment to perform various operations. For example, backhoes often have a plurality of control levers and/or foot pedals to control various functions of a backhoe, such as a position of a boom arm, a position of a dipperstick arm coupled to the boom arm, and a position of a bucket coupled to a dipperstick arm.

The magnitude of movement of an input device, such as a control lever, generally controls the output, i.e. force and/or velocity, of a given device, such as a dipperstick arm on a backhoe. Some operations require precision output of a given device, such as digging around an pipe with a backhoe. Under such circumstances, it is desirable to control the output of the dipperstick arm relative to the pipe or other object. Such operations would be aided by greater control of the output, such as greater control of the force and/or velocity of the dipperstick arm.

Hydraulic systems may use accumulators to store energy in the form of pressurized fluid. Accumulators may acquire pressurized fluid under the influence of an over-running load. When construction equipment lowers a load, the force of gravity on the equipment and the load provides pressurized fluid to the accumulator. This pressurized fluid can perform additional work or remain stored in an accumulator. When lowering the load, pressurized fluid is directed into the accumulator that typically has a pre-charge and fixed volume. Pressurized fluid is then available at a nearly constant pressure level from the accumulator for later reuse or distribution to various components or devices of the equipment to perform various operations.

SUMMARY

According to one aspect of the present invention, a vehicle is provided including a chassis, a ground engaging device supporting the chassis, and a hydraulic system supported by the chassis. The hydraulic system includes a hydraulic cylinder including a housing and a piston assembly. The housing encloses at least a portion of the piston assembly. The piston assembly includes a piston head and a piston rod. The piston head includes a bore-side surface and a rod-side surface opposite the bore-side surface. The housing and the bore-side surface defining a bore chamber. The housing and the rod-side surface define a rod chamber. The hydraulic system further includes a pressure source in fluid communication with the bore chamber to provide pressurized fluid to the bore chamber. The pressure source is in fluid communication with the rod chamber to provide pressurized fluid to the rod chamber. The hydraulic system further includes at least one valve configured to regulate fluid communication between the pressure source and the rod chamber and a control system coupled to the at least one valve to periodically alter the supply of pressurized fluid to the rod chamber. The control system is configured to command the at least one valve to automatically, periodically alternate between an open command and a close command in relation to a desired output of the hydraulic cylinder.

According to another aspect of the present invention, a method of generating a dynamic variable average flow applied by a hydraulic system of a vehicle is provided. The method includes the step of providing a vehicle including a hydraulic system including a hydraulic cylinder and a pressure source. The hydraulic cylinder includes a piston including a bore-side surface and an rod-side surface. The hydraulic cylinder is fluidly coupled to the pressure source to receive pressurized fluid. The method further includes the step of periodically providing pressure to at least one of the bore-side surface and the rod-side surface based on a duty cycle, and adjusting the duty cycle in response to at least one operator input.

According to another aspect of the present invention, a vehicle is provided that includes a chassis, a ground engaging device supporting the chassis, and a hydraulic system supported by the chassis. The hydraulic system includes a hydraulic cylinder, a pressure source in fluid communication with the hydraulic cylinder to provide pressurized fluid, at least one valve configured to regulate fluid communication between the pressure source and the hydraulic cylinder, a control system coupled to the at least one valve to periodically alter the supply of pressurized fluid to the hydraulic cylinder on a duty cycle, and an operator input in communication with the control system. The control system adjusts the duty cycle based on the input from the operator.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
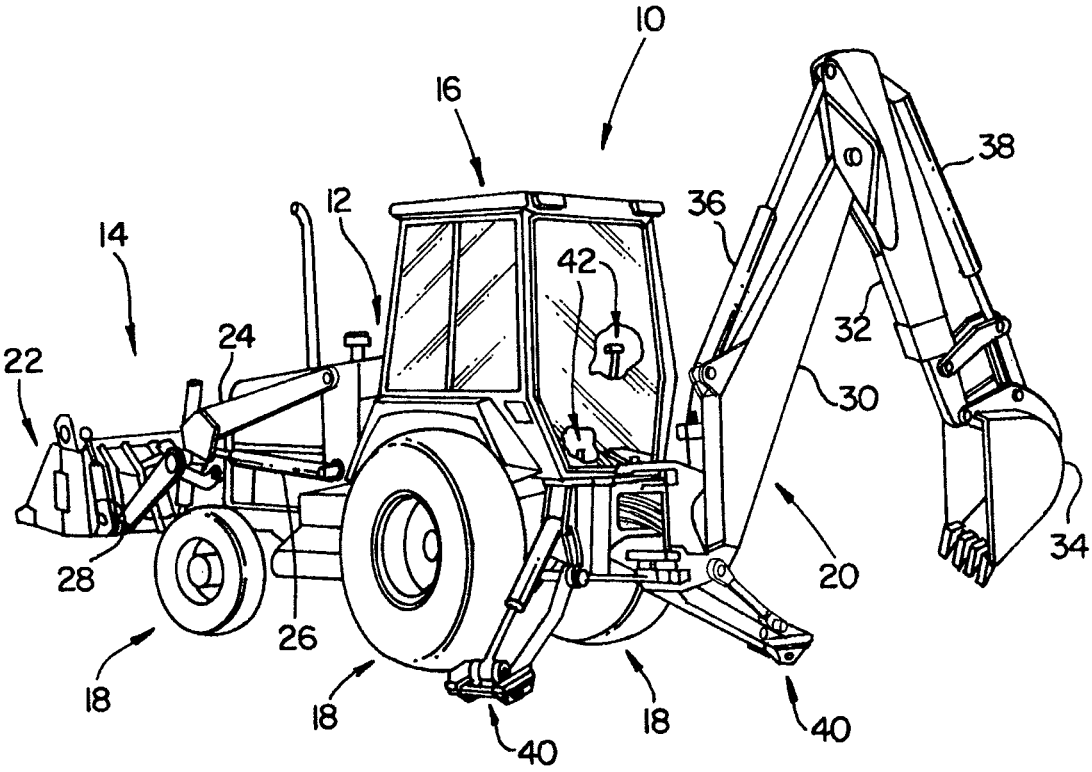
FIG. 1 is a perspective view of an exemplary vehicle.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE DRAWINGS

The embodiments disclosed below are not intended to be exhaustive or limit the invention to the precise forms disclosed in the following detailed description. Rather, the embodiments are chosen and described so that others skilled in the art may utilize their teachings.

As illustratively shown in FIG. 1, vehicle 10 is able to perform many different operations to move dirt or other materials. Although a backhoe loader is illustratively shown as an exemplary vehicle, vehicle 10 may be any suitable vehicle such as graders, bulldozers, and the like.

Vehicle 10 includes chassis 12, blade assembly 14, operator compartment 16, ground engaging devices 18, and implements, such as backhoe 20. Blade assembly 14, operator compartment 16, and backhoe 20 are supported by chassis 12. Blade assembly 14 also includes implement or bucket 22 which is supported by support arms 24 (only one shown). Bucket 22 and support arms 24 may be raised and lowered relative to chassis 12 by hydraulic cylinders 26. Bucket 22 may be moved relative to support arms 24 by hydraulic cylinders 28.

Similarly backhoe 20 of vehicle 10 is supported by chassis 12. Backhoe 20 may be used to dig trenches and/or move material through the movement of boom arm 30, dipper stick arm 32, and bucket 34. Boom arm 30 is supported by chassis 12. Dipper stick arm 32 is moveably coupled to boom arm 30. Dipper stick arm 32 may be raised or lowered relative to boom arm 30 through hydraulic cylinders 36. Bucket 34 is moveably coupled to dipper stick arm 32. Bucket 34 may be moved relative to dipper stick arm 32 by hydraulic cylinder 38.

Vehicle 10 is propelled by plurality of ground engaging devices 18. When additional stability is desired, a plurality of stabilizers 40 may be lowered to increase the base of vehicle 10.

An operator, positioned within operator compartment 16, controls movement of blade assembly 14, backhoe 20, and vehicle 10. Although operator compartment 16 is shown as an enclosed compartment, operator compartment 16 may be opened or partially enclosed. The operator controls bucket 22, blade assembly 14, backhoe 20 and the movement of vehicle 10 through operator input devices 42, such as levers, joysticks, etc. located within operator compartment 16. Operator input devices 42 are configured to control hydraulic cylinders 26, 28, 36, and 38 as well as other devices.

The position and orientation of hydraulic cylinders 26, 28, 36, and 38 are exemplary, as is the position and orientation of all the hydraulic cylinders discussed throughout. Hydraulic cylinders 26, 28, 36, and 38 are positioned and oriented such that they perform work either through expansion or retraction. Similarly, hydraulic cylinders 26, 28, 36, and 38 may have an over-running load during either expansion or retraction.

Figure 2:
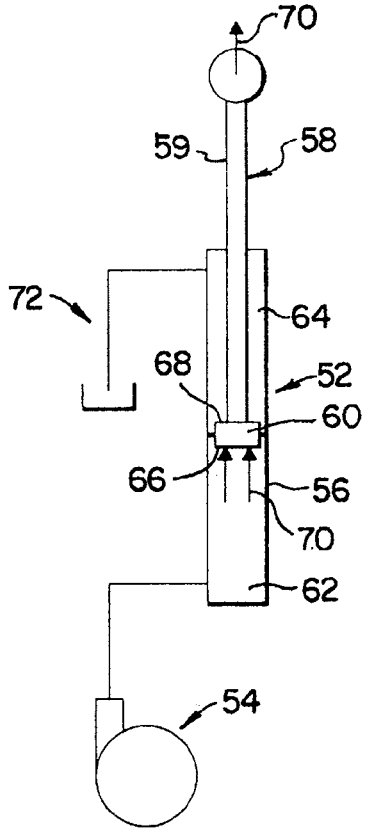
FIG. 2 is a diagrammatic view of an exemplary hydraulic system in a first, full operation mode.
Figure 3:
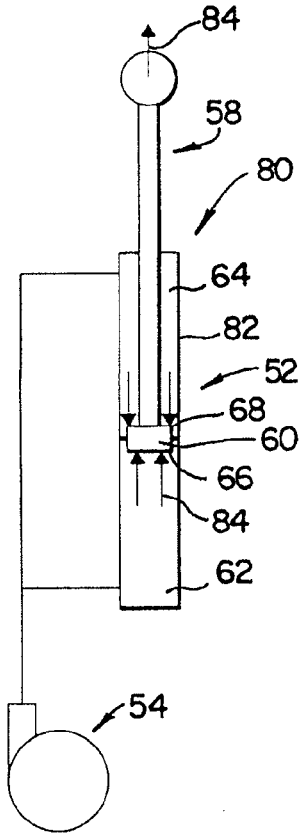
FIG. 3 is a diagrammatic view of the hydraulic system of FIG. 2 in a second, partial operation mode.

FIGS. 2 and 3 illustrate separate modes of operation of a double acting cylinder 52 of vehicle 10, which illustrate one or more of hydraulic cylinders 26, 28, 36, 38 or the other hydraulic cylinders of vehicle 10. FIG. 2 shows a first or full output mode configured to push piston assembly 58 with full output 70 (i.e., a maximum force and/or maximum velocity available from pressure source 54). FIG. 3 shows a second or partial output hydraulic mode configured to push piston assembly 58 with partial output 84 (i.e., a partial force and/or partial velocity available from pressure source 54).

Pressure source 54 may be an accumulator, pump, or other source of pressure. Hydraulic cylinder 52 includes housing 56 and a piston assembly 58 that includes piston rod 59 and piston head 60. Housing 56 and piston head 60 define bore chamber 62. Housing 56 and piston head 60 also define rod chamber 64 on the opposite side of piston head 60 from bore chamber 62. Piston head 60 defines bore-side surface 66 and rod-side surface 68 opposite and smaller than bore-side surface 66.

Referring to FIG. 2, when in full output mode, pressure source 54 provides pressurized fluid to bore chamber 62 which pushes piston assembly 58 with full output 70. Full output 70 is also characterized as full force 70 and/or full velocity 70. At full output 70, the output of cylinder 52 equals the pressure of pressure source 54 times the area of bore-side surface 66 less any frictional losses.

As shown in this embodiment, fluid present in rod chamber 64 is returned to tank or reservoir 72. Tank or reservoir 72 may also be an accumulator for receiving pressurized fluid for later reuse or distribution to various components or devices of the equipment to perform various operations. Full output 70 is illustrated as an extension of piston assembly 58 of hydraulic cylinder 52. Full output 70 may also occur during retraction of hydraulic cylinder 52.

Referring now to FIG. 3, when in partial output mode pressurized fluid is provided to both bore chamber 62 and rod chamber 64. Forces on rod-side surface 68 oppose forces on bore-side surface 66. However, because bore-side surface 66 is larger than rod-side surface 68, cylinder 52 still expands, but with less force and velocity that if cylinder 52 were in the full output mode. Partial output 84 is illustrated above as an extension of piston assembly 58 of hydraulic cylinder 52. It is also envisioned that partial output 84 can be used to retract hydraulic cylinder 52. For example, it is also envisioned that pressure source 54 is capable of providing pressurized fluid to rod chamber 64 without providing pressurized fluid to bore chamber 62.

In the preferred embodiment of the present disclosure, rod-side surface 68 is a fraction of the surface area of bore-side surface 66. For example, rod-side surface 68 may comprise one half of the surface area of bore-side surface 66. In this embodiment, the output movement (i.e. force and/or velocity) of piston assembly 58 in the partial output mode is roughly one half the output movement, (i.e., force and/or velocity) in relation to piston assembly 58 of full output mode. Rod-side surface 68 can be a greater surface area than bore-side surface 66, the same surface area as bore-side surface 66, or a small fraction (such as one-fourth) of the surface area of bore-side surface 66.

According to the present disclosure, one or move valves are provided to control the switching of cylinder 52 between the full output mode of FIG. 2 and the partial output mode of FIG. 3. By alternating between the modes at controlled rates, the output of cylinder 52 can be adjusted between full output and partial output. For example, the longer full output mode is on the closer the output of cylinder 52 will be to full output. The longer partial output mode is on, the closer to the output of cylinder 52 will be to partial output. Thus, rather than having only two outputs (full output and partial output), cylinder 52 can have variable outputs ranging from the full output to partial output.

Figure 5:
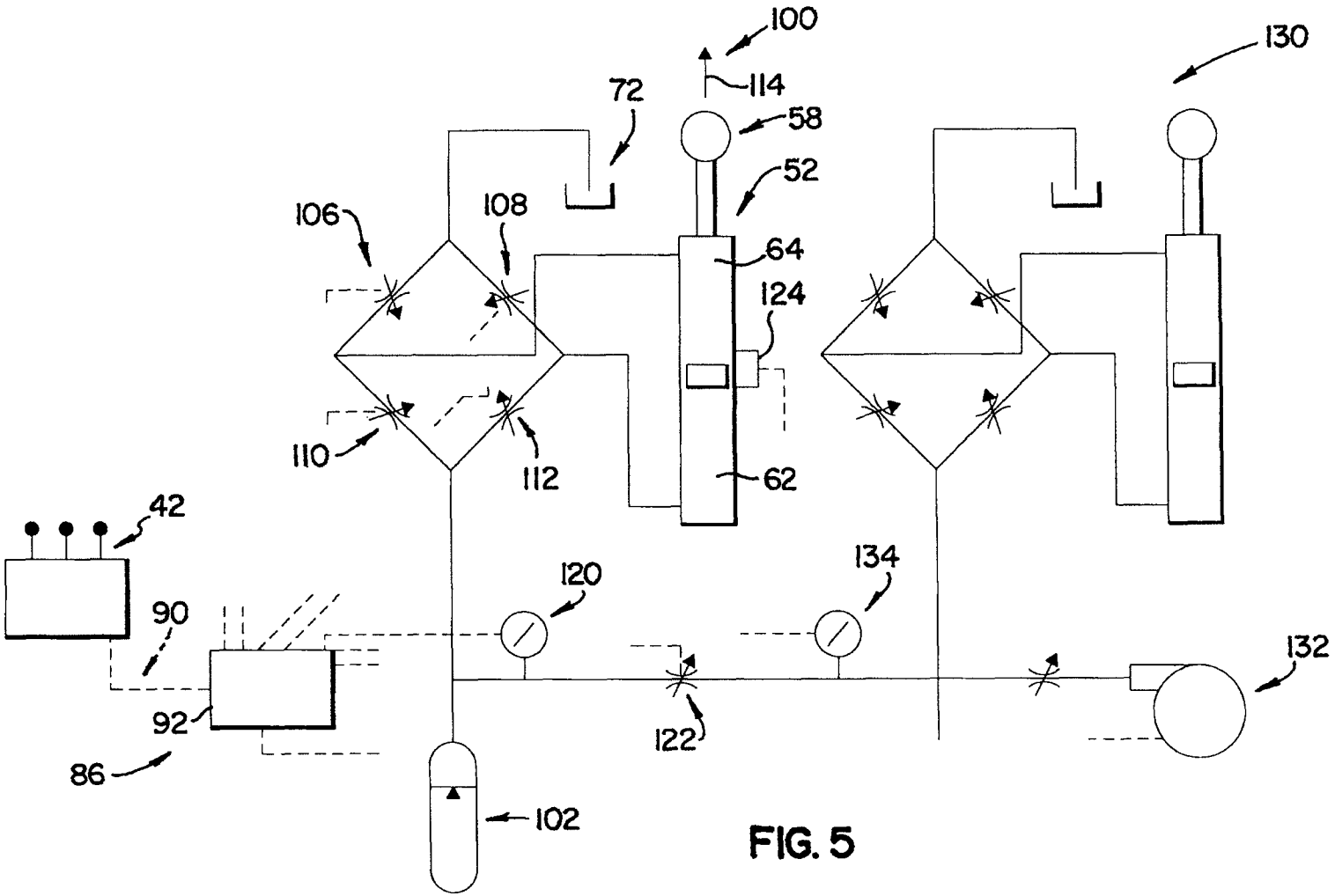
FIG. 5 is a diagrammatic view of a preferred embodiment hydraulic system.

Now referring to FIG. 5, exemplary hydraulic control system 86 is illustrated. An operator manipulates operator input device(s) 42 to request a desired extension velocity or force for cylinder 52. Input device(s) 42 creates an operator input 90 to controller 92. Controller 92 receives the operator input (s) 90 and observes the available pressure from pressure source 54. Based on the requested extension velocity (as indicated by operator input 90) and the available pressure, controller 92 controls how long cylinder 52 operates in the full output mode (as shown in FIG. 2) and how long cylinder 52 operations in the partial output mode (as shown in FIG. 3). Dashed lines are shown in FIG. 5 to show electronic (or other) communication lines between controller 90 and various other components.

Figure 4:
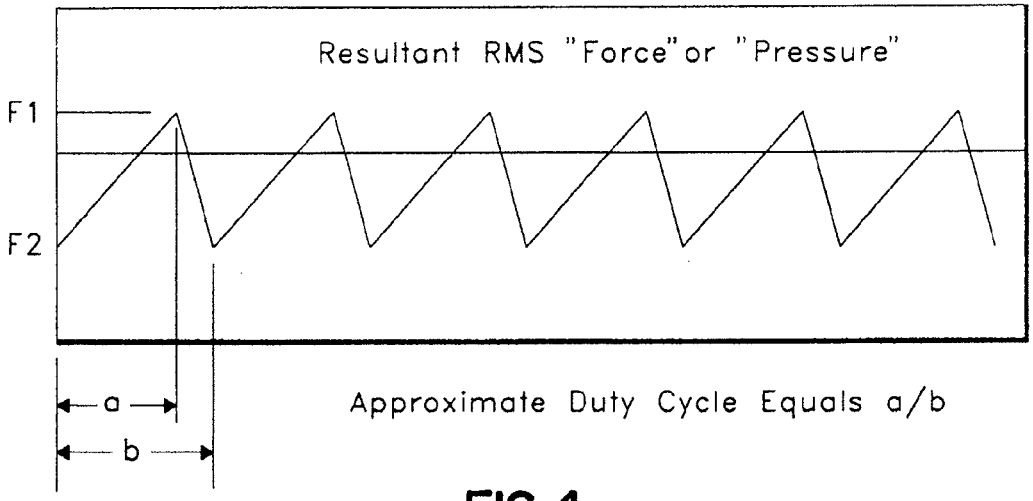
FIG. 4 is a representation of a series of cycles showing the hydraulic system of FIG. 2 rapidly switching between the first and second modes at a duty cycle providing a resultant or "RMS" force or pressure.

According to the preferred embodiment, cylinder 52 rapidly switches between the full operating mode and partial operating modes using a duty cycle as shown in FIG. 4. Each cycle has period of time between each pulse (b) and the length of each pulse lasts (a). The ratio of pulse length (a) to the period between pulses (b) is the duty cycle. The duty cycle may range from 0 to 1. When the duty cycle is 0, cylinder 52 always operates in the partial output mode providing force or pressure at F2 as shown. When the duty cycle is 1, cylinder 52 always operates in the full output mode providing pressure at F1 as shown. The closer the duty cycle is to 0, the closer the extension velocity (or force) of cylinder 52 is to the extension velocity of cylinder 52 in the partial output mode. The closer the duty cycle is to 1, the closer the extension velocity (or force) of cylinder 52 is the extension of cylinder 52 in the fully output mode. The resultant output of the periodic switching between full and partial operating modes is the root mean square of the inputs as shown in FIG. 4.

Depending on operator input signal 90, controller 92 adjusts the duty cycle. For example, if the operator requests faster extension of cylinder 52 or more force, controller 92 responds by increasing the duty cycle. If the operator requests slower extension of cylinder 52 or less force, controller 92 responds by decreasing the duty cycle. The output of cylinder 52 is a function of the force of cylinder 52 while operating in the full output mode, the force of cylinder 52 while operating in the partial output mode, and the duty cycle. The force of cylinder 52 while operating in the full output mode is a function of the pressure supplied by pressure source 54 and the geometry of cylinder 52 (ex. the surface area of bore-side surface 66). Similarly, the force of cylinder 52 while operating in the partial output mode is a function of the pressure supplied by pressure source 54 and the geometry of cylinder 52 (ex. the area of bore-side surface 66 and the area of rod-side surface 68). Preferably, the duty cycle is adjusted by increasing or decreasing the length of each pulse (a). However, the duty cycle may also be adjusted by decreasing or increasing the period of time between each pulse (b); some combination of this and adjusting the length of each pulse (a); or in any other manner.

The length of time between each pulse (b) impacts the perceptibility of the switching between the full output mode and the partial output mode. The longer the length of time between each pulse (b), the less perceptible the switching becomes. For example, if the length of time between each pulse (b) was one minute and the duty cycle was 50%, the operator would likely notice the changing of velocity every 30 seconds. However, if the length of time between each pulse (b) is much shorter, the operator would not notice the rapid changes in the velocity of the extension. Furthermore, damping because of the mass and other characteristics of cylinder 52 and the other components of vehicle 10 will further reduce the perceptibility of changes in output velocity (or force) of cylinder 52. As a result, the operator perceives that cylinder 52 extends at a constant average velocity, even though cylinder 52 is rapidly operating in different modes. The "average" pressure (or force) of cylinder 52 may also be referred to as the root mean square of the pressures received by cylinder 52. This root mean square pressure (or force) is a function of the duty cycle and the pressure provided by pressure source 54. Additionally, the load being moved by cylinder 52 will also influence the output of cylinder 52.

Now referring to FIG. 5, a preferred embodiment hydraulic system 100 is illustrated. Hydraulic system 100 includes pressure source/accumulator 102 which provides pressurized fluid at a nearly constant pressure level. Hydraulic system 100 also includes cylinder 52 discussed above. As discussed in greater detail below, hydraulic system 100 includes high speed, switching valves 106, 108, 110, and 112. Switching valves 106, 108, 110, and 112 direct fluid from pressure source 54 to bore-side surface 66 to provide full output 70, as discussed above, and direct fluid from pressure source 54 to bore-side surface 66 and rod-side surface 68 to provide partial output 84, as discussed above.

Switching valves 106, 108, 110, and 112 are each coupled to a hydraulic system controller 92. Preferably, switching valves 106, 108, 110, and 112 are high speed switching valves with high frequency response. For example, according to one embodiment, the frequency response is 5 Hz (or 200 milliseconds switching time). According to another embodiment, the frequency response is 25 Hz (or 40 millisecond switching time). Valves with greater or lesser frequency responses may also be used. The exact frequency response will depend on the selected valve and other factors, such as system pressures. It is envisioned that faster switching times and response times may lead to improved efficiency and less perceptibility.

High speed switching valve 110 is configured to open or close communication of pressurized fluid to or from rod chamber 64 and is also referred to as rod valve 110. High speed switching valve 112 is configured to open or close communication of pressurized fluid to or from bore chamber 62 and is also referred to as bore valve 112. As show in Table 1, hydraulic controller 92 commands high speed switching valves 106, 108, 110, and 112 to open or close to switch between full output 70 of FIG. 2 and partial output 84 of FIG. 3 in accordance with the calculated duty cycle.

TABLE 1

Hydraulic Control Logic Commands

| | High Speed Switching Valves | | | |
|---|---|---|---|---|
| Valve | 106 | 108 | 110 | 112 |
| Full output | Open | Closed | Closed | Open |
| Partial output | Closed | Closed | Open | Open |

When in the full output mode, valve 106 is open to release pressure from rod chamber 64 to tank 72 and valve 110 is closed to block pressure from pressure source 102. As a result, cylinder 52 attempts to provide full velocity (or force). When in the partial output mode, valve 110 is open to provide pressure to rod chamber 64 and valve 106 is closed to block the escape of fluid to tank 72. As a result, cylinder 52 attempts to provide partial output velocity (or force). Valve 112 remains open during extension of cylinder 52 to constantly provide pressured fluid to bore chamber 62. Similarly, valve 108 remains closed during extension of cylinder 52 to block the escape of fluid to tank 72.

Hydraulic system 100 optionally includes pressure gauge 120 and valve 122. Hydraulic controller 92 may seek to send pressurized fluid to other systems such as another accumulator or an optional hydraulic system 130 to control another implement of vehicle 10. Hydraulic system 130 is similar to hydraulic system 100. Hydraulic system 130 includes pressure source 132, such as a pump, and pressure gauge 134. Hydraulic controller 92 may also seek to equalize pressure readings between pressure gauge 120 and pressure gauge 134 by commanding valve 122 to open. If controller 92 detects that system 130 needs additional pressure and gauge 120 indicates that accumulator 102 has adequate pressure, controller 92 will open valve 122 to allow pressurized fluid to flow to system 130. Similarly, if system 100 needs pressure, controller 92 may open valve 122 to provide pressure from pressure source 132 or otherwise from system 130.

As previously discussed, when vehicle 10 (i.e., such as bucket 22 or support arms 24) lowers a load, also known as over-running load, force placed upon piston assembly 58 may pressurize fluid within bore chamber 62 (or rod chamber 64 depending on the location of the load). Hydraulic controller 92, using high speed switching valves 106, 108, 110, and 112, can also be used to send pressurized fluid out of bore chamber 62 (and rod chamber 64) to a second implement (ex., boom arm 30) of vehicle 10. For example, when an operator wants to lower a load, they may move operator input 42 in the opposite direction. As a result, valve 122 opens and provides a pressure relief path (assuming the pressure of hydraulic system 130 is less than system 100). Pressure in bore chamber 62 (and rod chamber 64) dumps to system 130 to allow retraction of cylinder 52. The pressure from bore chamber 62 may be stored in an accumulator, such as accumulator 102, or another accumulator.

As shown in FIG. 5, vehicle 10 may include a cylinder position sensor 124 that monitors the position of cylinder 52. Based on the monitored position, controller 92 can determine the position cylinder 52 and the velocity of the extension of rod 59. Controller 92 may compare the actual velocity of rod 59 to the velocity the operator requested through operator input 42. If the velocity is too slow, controller 92 may increase the duty cycle. If the velocity is too slow, controller 92 may decrease the duty cycle.

Similarly, if controller 92 increase the duty cycle to 1 (i.e. maximum output) and the desired velocity of rod 59 is not achieved, controller 92 may open valve 122 and provide increased pressure to system 100 from pump 132 or another source of higher pressure than accumulator 102.

Hydraulic controller 92 may command high speed switching valves 106, 108, 110, and 112 to all close at the same time (i.e. the all closed position). Hydraulic controller 92 may use all closed portion to buffer or slow changes between full output mode and partial output mode. By closing all of valves 106, 108, 110, 112, cylinder 52 has an opportunity to balance. Controller 92 may also use the all closed position to ensure that the actual movement of cylinder 52 does not exceed the operator input. For example, as error correction between the operator inputs and the actual movement as sensed by position sensor 124, the all closed position allows hydraulic system 100 to equilibrate.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A vehicle comprising:

a chassis, a ground engaging device supporting the chassis, a hydraulic system supported by the chassis, the hydraulic system including a hydraulic cylinder including a housing and a piston assembly, the housing enclosing at least a portion of the piston assembly, the piston assembly including a piston head and a piston rod, the piston head including a bore-side surface and a rod-side surface opposite the bore-side surface, the housing and the bore-side surface defining a bore chamber, the housing and the rod-side surface defining a rod chamber, a pressure source in fluid communication with the bore chamber to provide pressurized fluid to the bore chamber, the pressure source being in fluid communication with the rod chamber to provide pressurized fluid to the rod chamber, at least one valve configured to regulate fluid communication between the pressure source and the hydraulic cylinder, and a control system coupled to the at least one valve to periodically alter the supply of pressurized fluid to the hydraulic cylinder based on a duty cycle the hydraulic cylinder in a a partial output mode, in which pressurized fluid is simultaneously supplied to both the bore chamber and the rod chamber of the hydraulic cylinder so that the pressurized fluid moves the piston assembly.

2. The vehicle of claim 1, wherein the pressure source is an accumulator.

3. The vehicle of claim 1, wherein the at least one valve is a switching valve.

4. The vehicle of claim 3, wherein the switching valve has a frequency response of about 5 Hz or greater.

5. The vehicle of claim 1, further comprising a bore valve configured to regulate fluid communication between the pressure source and the bore chamber.

6. The vehicle of claim 1, wherein the hydraulic cylinder is a double acting hydraulic cylinder.

7. The vehicle of claim 1, wherein the rod-side surface is smaller than the bore-side surface.

8. The vehicle of claim 1, further comprising an operator input for determining the duty cycle of the at least on valve.

9. The vehicle of claim 1, wherein the control system is also configured to operate the hydraulic cylinder in a full output mode, in which pressurized fluid is supplied to one of the bore chamber and the rod chamber of the hydraulic cylinder.

10. A method of generating a dynamic variable average flow applied by a hydraulic system of a vehicle, the method comprising the steps of:

providing a vehicle including a hydraulic system including a hydraulic cylinder and a pressure source, the hydraulic cylinder including a piston including a bore-side surface and an rod-side surface, the hydraulic cylinder being fluidly coupled to the pressure source to receive pressurized fluid, periodically providing pressure simultaneously to both the bore-side surface and the rod-side surface based on a duty cycle so that the pressurized fluid moves the piston, and adjusting the duty cycle in response to at least one operator input.

11. The method of claim 10, wherein the pressure source is an accumulator.

12. The method of claim 11, wherein the accumulator stores pressurized fluid at a nearly constant pressure.

13. The method of claim 10, wherein the hydraulic cylinder is a double acting hydraulic cylinder.

14. The method of claim 10, wherein the rod-side surface is smaller than the bore-side surface.

15. The method of claim 14, further comprising the step of determining error in the adjusting step and adjusting the duty cycle to reduce the error.

16. A vehicle comprising:

a chassis, a ground engaging device supporting the chassis, and a hydraulic system supported by the chassis, the hydraulic system including a hydraulic cylinder including a piston assembly, a pressure source in fluid communication with the hydraulic cylinder to provide pressurized fluid, at least one valve configured to regulate fluid communication between the pressure source and the hydraulic cylinder, a control system coupled to the at least one valve to periodically alter the supply of pressurized fluid to the hydraulic cylinder based on a duty cycle to operate the hydraulic cylinder in a partial output mode, in which pressurized fluid is supplied to the hydraulic cylinder to simultaneously act on the piston assembly in opposing directions so that the pressurized fluid moves the piston assembly, and an operator input in communication with the control system, the control system adjusting the duty cycle based on the input from the operator.

17. The vehicle of claim 16, wherein the pressure source is an accumulator.

18. The vehicle of claim 16, wherein the at least one valve is a switching valve.

19. The vehicle of claim 18, wherein the switching valve has a frequency response of about 5 Hz or greater.

20. The vehicle of claim 16, wherein the hydraulic cylinder is a double acting hydraulic cylinder.

21. The vehicle of claim 16, wherein the control system increases the duty cycle in response to an operator requesting an increase in the velocity of extension of the hydraulic cylinder.

22. The vehicle of claim 16, wherein the control system is also configured to operate the hydraulic cylinder in a full output mode, in which pressurized fluid is supplied to the hydraulic cylinder to act on the piston assembly in one direction.

* * * * *